US009768505B2

(12) United States Patent
Cho et al.

(10) Patent No.: US 9,768,505 B2
(45) Date of Patent: Sep. 19, 2017

(54) MIMO ANTENNA WITH NO PHASE CHANGE

(75) Inventors: Jeong Hoon Cho, Seoul (KR); Kyung Suk Kim, Seoul (KR); Ja Kwon Ku, Seoul (KR); Sung Tek Kahng, Seoul (KR); Geon Ho Jang, Seoul (KR); Seong Ryong Yoo, Seoul (KR)

(73) Assignees: LG INNOTEK CO., LTD., Seoul (KR); INDUSTRY-ACADEMIC COOPERATION FOUNDATION INCHEON NATIONAL UNIVERSITY, Incheon (KR)

( * ) Notice: Subject to any disclaimer, the term of this patent is extended or adjusted under 35 U.S.C. 154(b) by 394 days.

(21) Appl. No.: 13/978,359

(22) PCT Filed: Oct. 10, 2011

(86) PCT No.: PCT/KR2011/007493

§ 371 (c)(1),
(2), (4) Date: Nov. 12, 2013

(87) PCT Pub. No.: WO2012/093766

PCT Pub. Date: Jul. 12, 2012

(65) Prior Publication Data

US 2014/0055319 A1 Feb. 27, 2014

(51) Int. Cl.
*H01Q 1/24* (2006.01)
*H01Q 1/38* (2006.01)
(Continued)

(52) U.S. Cl.
CPC ..... *H01Q 5/0093* (2013.01); *H01Q 1/243* (2013.01); *H01Q 1/38* (2013.01); *H01Q 3/24* (2013.01); *H01Q 5/50* (2015.01); *H01Q 21/28* (2013.01)

(58) Field of Classification Search
CPC H01Q 1/38; H01Q 1/243; H01Q 5/50; H01Q 5/0093; H01Q 3/24; H01Q 1/36;
(Continued)

(56) References Cited

U.S. PATENT DOCUMENTS 6,339,404 B1 * 1/2002 Johnson ..... H01Q 1/243 343/700 MS
6,839,040 B2 * 1/2005 Huber ..... H01Q 1/243 343/700 MS
(Continued)

FOREIGN PATENT DOCUMENTS

KR 10-2005-0107881 A 11/2005
KR 10-0737588 B1 7/2007
(Continued)

OTHER PUBLICATIONS

The ARRL Antenna Book, Published by The American Radio Relay League. Gerald Hall.*
(Continued)

*Primary Examiner* — Jessica Han
*Assistant Examiner* — Awat Salih
(74) *Attorney, Agent, or Firm* — Saliwanchik, Lloyd & Eisenschenk

(57) ABSTRACT

A multi input multi output (MIMO) antenna with no phase change is provided. The MIMO antenna having no phase change constituting one antenna structure overall, wherein unit structures at both sides are symmetrical to each other in a meander form with respect to the center; the unit structures having the meander form are connected to a ground plate by using as a medium power feeding units 240 and 250 supplying an electric energy to the respective unit structures; and the unit structures are installed with a three-dimensional structure, being adjacent to the ground plate.

8 Claims, 5 Drawing Sheets

(51) Int. Cl.
*H01Q 5/00* (2015.01)
*H01Q 3/24* (2006.01)
*H01Q 21/28* (2006.01)
*H01Q 5/50* (2015.01)

(58) Field of Classification Search
CPC ..... H01Q 21/205; H01Q 1/521; H01Q 1/28; H01Q 21/28; H01Q 1/526; H01Q 1/52; H01Q 1/24; H01Q 1/46
USPC ..... 343/702, 841, 895, 845
See application file for complete search history.

(56) References Cited

U.S. PATENT DOCUMENTS 6,967,631 B1* 11/2005 Park ..... H01Q 1/36 343/702
7,358,906 B2* 4/2008 Sato et al. ..... 343/702
2004/0001023 A1* 1/2004 Peng ..... H01Q 1/38 343/725
2007/0046543 A1* 3/2007 Choi ..... H01Q 1/22 343/700 MS
2008/0074341 A1* 3/2008 Chung ..... H01Q 1/243 343/841
2008/0246685 A1* 10/2008 Ying ..... H01Q 1/243 343/878
2009/0027278 A1* 1/2009 Soora ..... H01Q 1/243 343/702
2010/0171676 A1* 7/2010 Tani ..... H01Q 1/243 343/803
2010/0295739 A1* 11/2010 Wu et al. ..... 343/702
2011/0115687 A1* 5/2011 Huang ..... H01Q 1/243 343/843
2012/0013519 A1* 1/2012 Hakansson ..... H01Q 1/243 343/835

FOREIGN PATENT DOCUMENTS

KR 10-2008-0008687 A 1/2008
KR 10-2009-0124252 A 12/2009
KR 984109 * 9/2010

OTHER PUBLICATIONS

The American Radio Relay League, by Gerald Hall.*
International Search Report in International Application No. PCT/KR2011/007493, filed Oct. 10, 2011.

* cited by examiner

[Fig. 1]
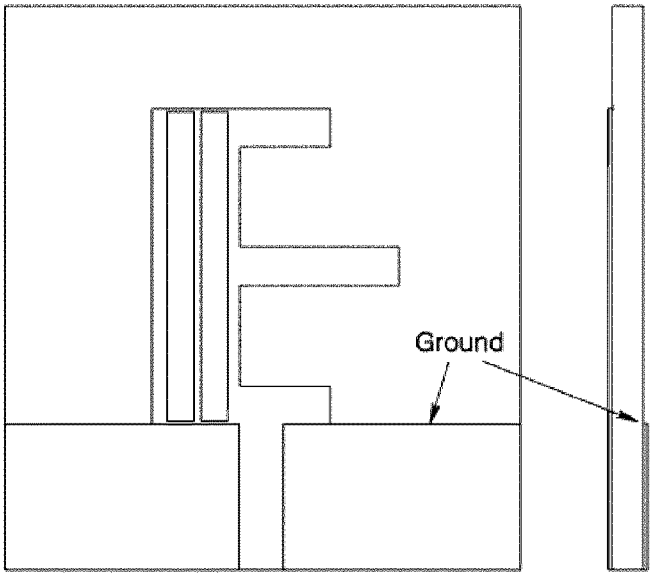
[Fig. 2]
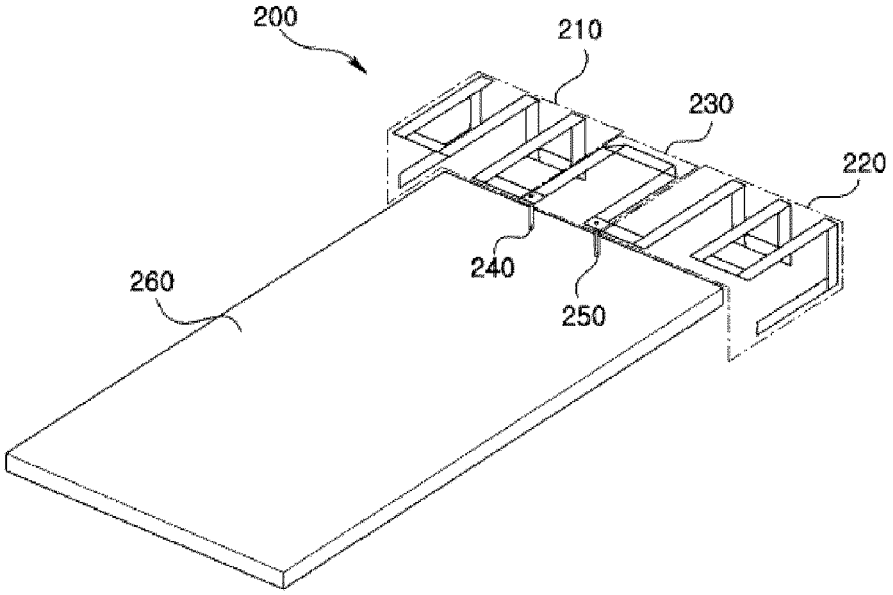
[Fig. 3]
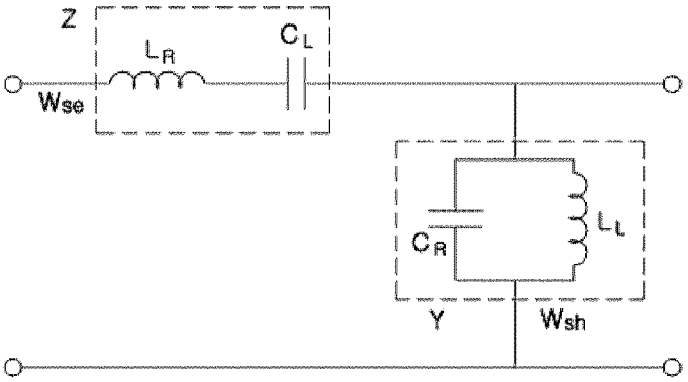

[Fig. 4]
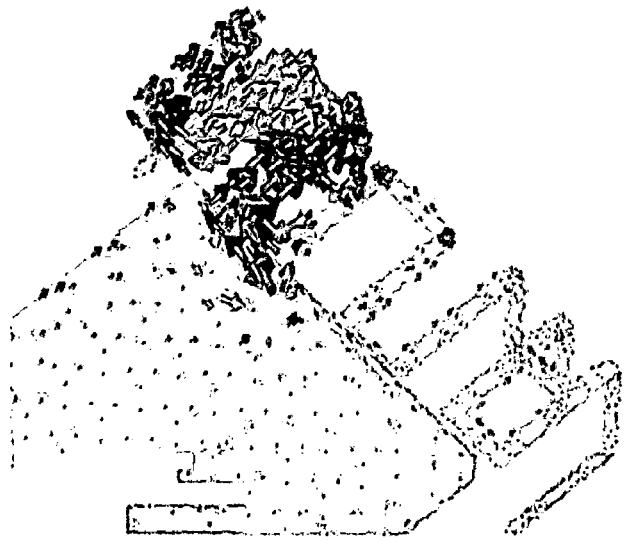
[Fig. 5]
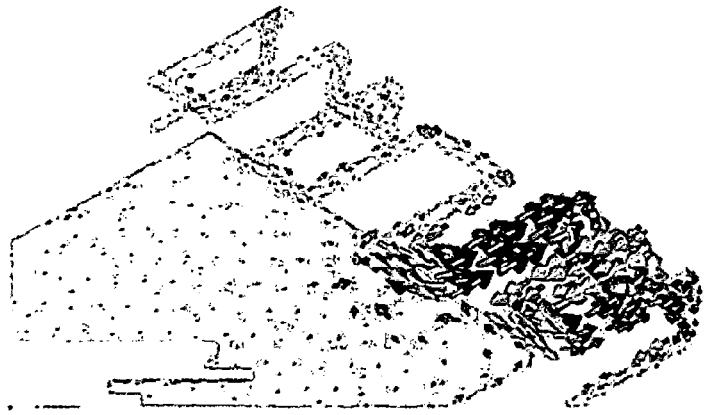
[Fig. 6]
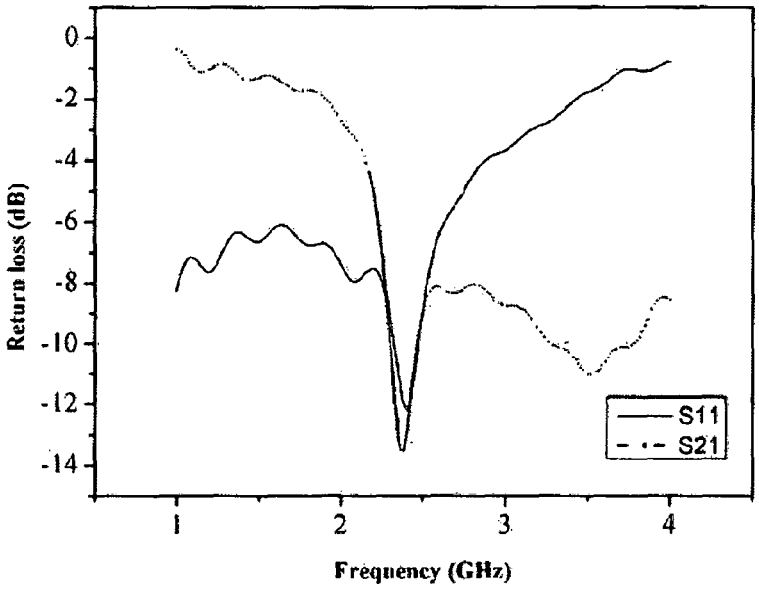

[Fig. 7]
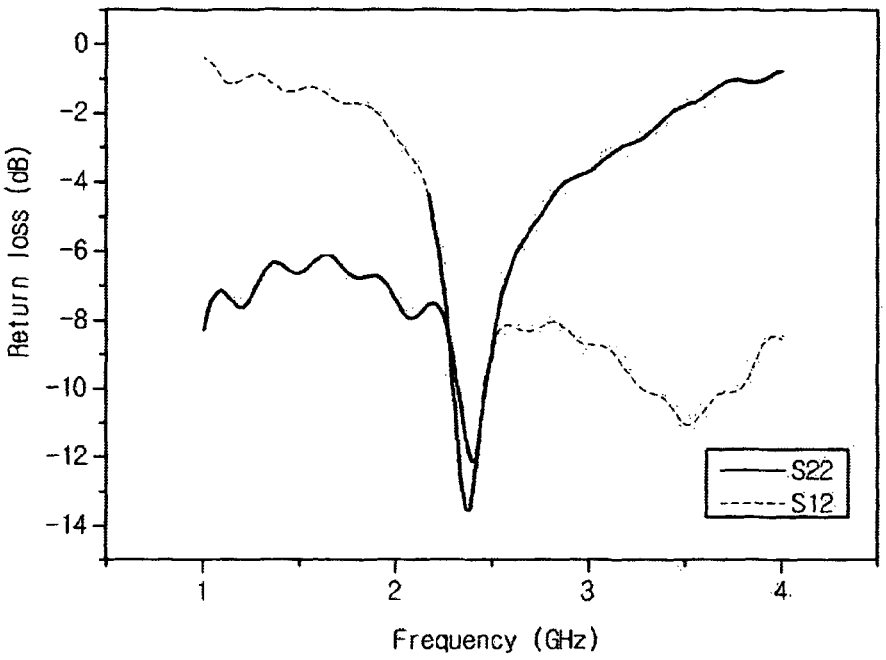
[Fig. 8]
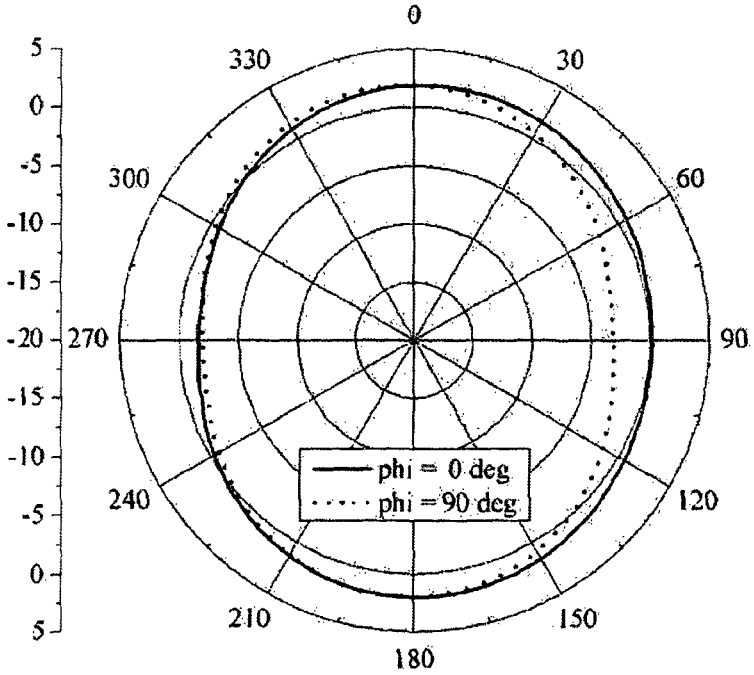

[Fig. 9]
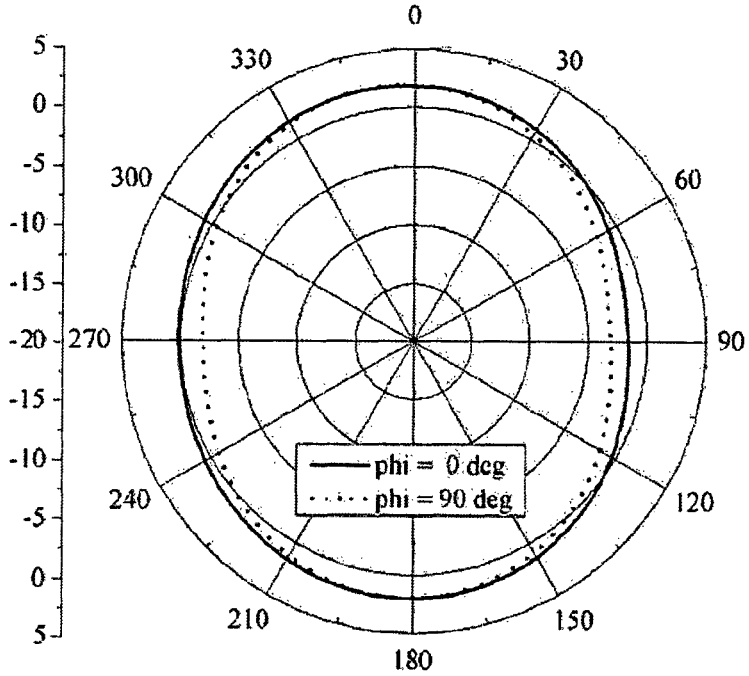
[Fig. 10]
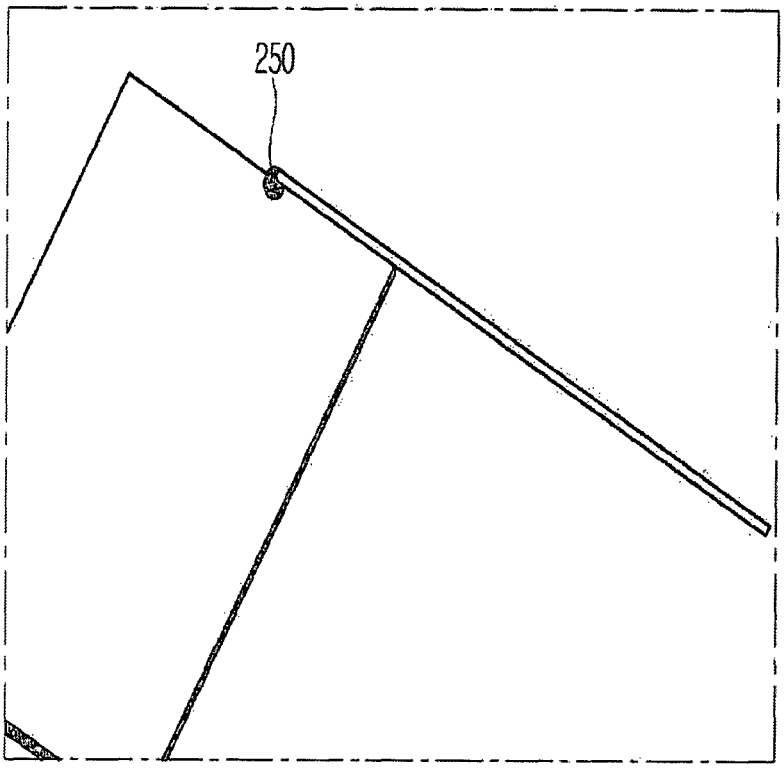

[Fig. 11]
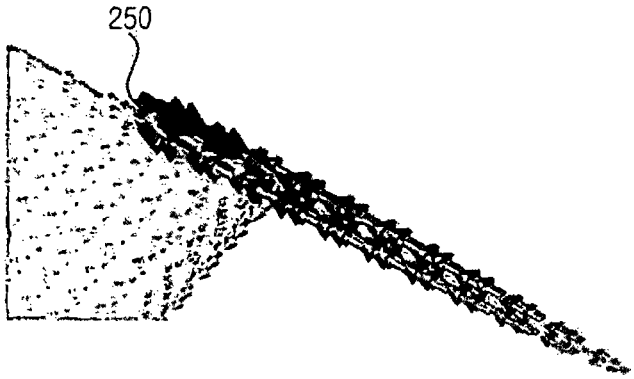
[Fig. 12]
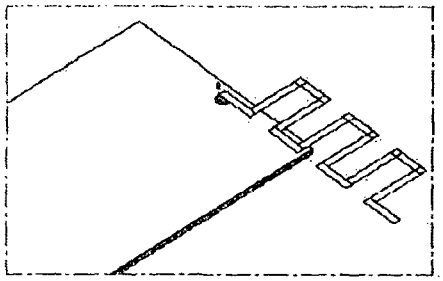
[Fig. 13]
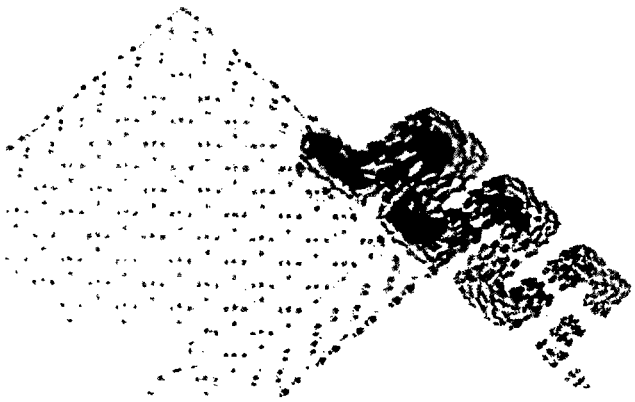

MIMO ANTENNA WITH NO PHASE CHANGE

CROSS-REFERENCE TO RELATED APPLICATIONS

This application is the U.S. national stage application of International Patent Application No. PCT/KR2011/007493, filed Oct. 10, 2011, which claims priority to Korean Application No. 10-2011-0000622, filed Jan. 4, 2011, the disclosures of each of which are incorporated herein by reference in their entirety.

TECHNICAL FIELD

The present disclosure relates to an antenna adopted for a small terminal, and more particularly, to a multi input multi output (MIMO) antenna with no phase change having a miniaturized size and improved gain and efficiency.

BACKGROUND ART

FIG. 1 is a view of a related art monopole antenna printed on a dielectric substrate.

Referring to FIG. 1, in relation to the related art monopole antenna, resonance occurs over a broad band with an impedance change through a selective ground. A path, through which current flows in an E-shape, is divided into a plurality through a slot. Additionally, resonance occurs at about 2.4 GHz via an outermost path of a flowing current.

DISCLOSURE OF INVENTION

Technical Problem

The related art monopole antenna is designed on the basis of a selective ground by printing an antenna form on a dielectric substrate, various antenna characteristics are very sensitive to a change of the ground. Moreover, an entire size of the antenna is fixed with a predetermined area (for example, about 35×38 $mm^2$), so that it is difficult to reduce the entire size and apply the antenna to a small device.

Solution to Problem

In one embodiment, a MIMO antenna having no phase change constituting one antenna structure overall, wherein unit structures at both sides are symmetrical to each other in a meander form with respect to the center; the unit structures having the meander form are connected to a ground plate by using as a medium power feeding units 240 and 250 supplying an electric energy to the respective unit structures; and the unit structures are installed with a three-dimensional structure, being adjacent to the ground plate.

Advantageous Effects of Invention

Embodiments provide a multi input multi output (MIMO) antenna with no phase change, in which its size is miniaturized by using an infinite wavelength metamaterial with no phase change and its gain and efficiency are improved by forming a decoupling structure at the center of a dipole antenna structure to suppress a mutual interference between antennas.

BRIEF DESCRIPTION OF DRAWINGS

FIG. 1 is a view of a related art monopole antenna printed on a dielectric substrate.

FIG. 2 is a view illustrating a configuration of a MIMO with no phase change according to an embodiment.

FIG. 3 is a view illustrating line characteristics of a typical metamaterial CRLH transmission line.

FIGS. 4 and 5 are views illustrating a direction of a flowing current through each antenna.

FIGS. 6 and 7 are views illustrating an S-Parameter illustrating insertion loss and isolation characteristics of an MIMO antenna having no phase change according to an embodiment.

FIGS. 8 and 9 are views illustrating an elevation angle radiation pattern of an MIMO antenna having no phase change according to an embodiment.

FIG. 10 is a view illustrating a structure of a typical monopole antenna.

FIG. 11 is a view illustrating a current flow of the monopole antenna of FIG. 10.

FIG. 12 is a view that a size of the antenna is designed with about λ/8 in a meander form of a transmission line (i.e., an antenna).

FIG. 13 is a view illustrating a current flow of the transmission line (i.e., an antenna) of FIG. 12.

MODE FOR INVENTION

Reference will now be made in detail to the embodiments of the present disclosure, examples of which are illustrated in the accompanying drawings.

FIG. 2 is a view illustrating a configuration of a multi input multi output (MIMO) with no phase change according to an embodiment.

Referring to FIG. 2, in relation to the MIMO antenna 200 with no phase change constituting one antenna structure overall, unit structures 210 and 220 at both sides are symmetrical to each other in a meander form with respect to the center. Additionally, the unit structures 210 and 220 having the meander form are connected to a ground plate 260 by using as a medium power feeding units 240 and 250 supplying an electric energy to the respective unit structures 210 and 220. The unit structures 210 and 220 are installed with a three-dimensional structure, being adjacent to the ground plate 260.

Here, the meander form of the unit structures 210 and 220 may have a 'ㄹ'-shape.

The unit structures 210 and 220 may have the 'ㄴ'-shape but may be formed with a three-dimensional structure, which is symmetric with respect to the center. That is, the 'ㄹ'-shape of the unit structures 210 and 220 may be seen as a 'ㄷ'-shape if seen from the top and the side.

Additionally, a decoupling structure 230 having a 'U' shape for suppressing a mutual interference between the unit structures 210 and 220 (i.e., antennas) at the both sides of the center is used to physically connect the unit structures 210 and 220.

Additionally, a line width of the unit structures 210 and 220 may be about 0.6 mm to about 1.0 mm and a length of the unit structures 210 and 220 as a single antenna may be about 45 mm to about 50 mm. Here, the line width of the unit structures 210 and 220 constituting the antenna may be about 0.8 mm and the length of the unit structures 210 and 220 as a single antenna may be about 47.8 mm. Here, numeral limitations (e.g., ranges and specific values) about the width and length of the antenna are based on the results obtained through simulations about a range or a value with which an entire size of an antenna is miniaturized and its performance is maximized.

Additionally, an interval d between the line widths of the unit structures 210 and 220 constituting the antenna may be designed with about 2 mm and a height h of the antenna may be designed with about 3 mm. Here, the numeral limitations about the interval d and the height H are based on the result obtained through simulations about a range or a value with which an entire size of an antenna is miniaturized and its performance is maximized.

Additionally, a size of a single antenna of the unit structures 210 and 220 constituting the antenna may be designed with about 9×7 $mm^2$, a size of the decoupling structure 230 having a U shape may be designed with about 3×7 $mm^2$, and an entire size of the antenna including the decoupling structure 230 may be designed with about 21×7 $mm^2$.

Here, the numeral limitations about the size of the single antenna, the size of the decoupling structure 230, and the entire size of the antenna are based on the results obtained through simulations about a range or a value with which an entire size of an antenna is miniaturized and its performance is maximized.

Hereinafter, the MINO antenna with no phase change according to an embodiment will be described further.

The present invention may provide a miniaturized antenna, in which its size is miniaturized by using an infinite wavelength metamaterial with no phase change through a line modification (for example, the above-mentioned meander structure) unlike a related art antenna having a λ/4 resonance. Additionally, the present invention may control a mutual interference between antennas by disposing the decoupling structure 230 between the unit structures 210 and 220 to connect them.

In a typical transmission line, a wave number (the number of waves in a unit length, which is identical to a reciprocal number of the waves) has a positive value increased linearly. However, in a case of composite right-left handed (CRLH) having a metamaterial structure property, the wave number is nonlinearly increased. Because of this characteristic, a region is divided into a left-handed (LH) region and a right-handed (RH) region and then is described.

According to LH wave characteristics, the slope of a wave number has a positive value and the wave number has a negative value in a specific frequency band. If the wave number is 0 or a negative value, a resonance point occurs in an LH region. Especially, if the wave number is 0 in a specific frequency band, a wavelength becomes infinite so that an antenna is micronized regardless of a structural resonance length.

As shown in FIG. 3, the CRLH transmission line (i.e., an antenna) includes a series inductance LR, a series capacitance CL, a parallel capacitance CR, and a parallel inductance LL. The series inductance LR and the parallel capacitance CR show RH characteristics and the series capacitance CL and the parallel inductance LL show LH characteristics. According to each of the RH and LH characteristics, cut-off frequency is determined to form a pass band.

Additionally, a series resonance Wse occurs through the series inductance LR and the series capacitance CL and a parallel resonance Wsh occurs through the parallel capacitance CR and the parallel inductance LL. If their frequencies are different from each other, an unbalanced bandgap is formed to show a cut-off characteristic. If their frequencies are the same, a balanced bandgap is formed.

A phase velocity of an entire electric energy (for example, a current) flowing through the CRLH transmission line is obtained by the sum of a phase velocity component in the RH region and a phase velocity component in the LH region. If the entire phase velocity is 0, metamaterial characteristics having no phase change occurs. If the phase velocity is 0, since a wavelength becomes infinite, an entire transmission line becomes inphase overall. Accordingly, regardless of a physical length of the transmission line (i.e., an antenna), electric and magnetic fields having the same size and direction are formed. This makes components miniaturized through a miniaturized antenna.

In a case of a double negative (DNG) transmission line (i.e., an antenna), when a series capacitance and a parallel inductance are introduced and effective permeability or effective permittivity is 0, a zeroth order resonance (ZOR) mode may be obtained. In a case of an epsilon-negative (ENG) transmission line (i.e., an antenna), when only a parallel inductance is introduced and effective permittivity is 0, a ZOR mode is obtained. That is, when a ZOR antenna is realized, the ENG transmission line (i.e., an antenna) is simpler than the DNG transmission line (i.e., an antenna).

Meanwhile, according to an embodiment, in order to obtain the metamaterial resonator characteristic of FIG. 3 by using a typical monopole antenna, as shown in FIG. 2, the transmission line is bent in a meander form to satisfy a parallel inductance value and a series capacitance value. That is, the series capacitance is obtained by the line interval d of FIG. 2 and the parallel inductance may be induced by the height h cut vertically downward as shown in FIG. 2. The metamaterial characteristics having no phase change may be confirmed through a radiation pattern of an antenna, an electric filed vector, and a current flow.

In relation to the MIMO antenna having no phase change according to an embodiment, the metamaterial characteristics will be confirmed through current flow. Due to characteristics of a typical antenna, an electric field vector is changed by about 180 in a half-wave resonant portion. Accordingly, current flows in an opposite direction. In a case of the metamaterial antenna having no phase change, since an electric field vector is formed throughout the antenna in the same direction, current flows in a single direction.

FIGS. 4 and 5 are views illustrating a direction of a flowing current through each antenna.

As shown in FIGS. 4 and 5, it is confirmed that a current in each antenna flows in the same direction through an entire antenna line including the decoupling structure 230 of FIG. 2. Through this, it shows that the antenna maintains characteristics of a no phase change metamaterial.

Here, a characteristic difference between an antenna of the present invention and a typical monopole antenna will be described with reference to FIGS. 10 to 13.

Referring to FIG. 10, it shows a structure of the typical monopole antenna and an initial operation for manufacturing the antenna of the present invention with a meander structure. At this point, a total length of the antenna (i.e., a transmission line) is designed with about λ/4.

FIG. 11 is a view illustrating a current flow of the monopole antenna of FIG. 10.

As shown in FIG. 11, it shows that a current direction in the power feeding unit 250 of FIG. 2 is opposite to that in a portion far from the power feeding unit 250.

FIG. 12 is a view that a size of the antenna is designed with about λ/8 in a meander form of a transmission line (i.e., an antenna). FIG. 13 is a view illustrating a current flow of the transmission line (i.e., an antenna) of FIG. 12.

Referring to FIG. 13, similar to the result of FIG. 11, it shows that a current flow of the power feeding unit 250 is in an opposite direction to that in a portion far from the power feeding unit 250. In order to make these directions identical, the present invention, as shown in FIG. 2, designs a three-dimensional transmission line structure. That is, in order to induce a parallel inductance from a structure of the transmission line (i.e., an antenna), a dipole structure bending the transmission line (i.e., an antenna) from top to bottom is designed.

Additionally, a current flowing through the decoupling structure 230 is accumulated on a single antenna, so that there is less interference between two antennas (i.e., unit structures). Accordingly, compared to when there is no decoupling structure, gain and efficiency of the antenna is further improved.

As mentioned able, the line width of the antenna is about 0.8 mm and the length of a single antenna is about 47.8 mm. Additionally, an interval D between antenna lines is about 2 mm and the height h of the antenna is about 3 mm. The size of the single antenna using the above line with a no phase change metamaterial structure is about 9×7 $mm^2$ and an entire size including the decoupling structure 230 is about 21×7 $mm^2$. Through this, it is confirmed that the size (e.g., about 21×7 $mm^2$) of the antenna according to an embodiment is much smaller than that (e.g., about 35×38 $mm^2$) of a typical antennal.

Moreover, FIGS. 6 and 7 are views illustrating an S-Parameter illustrating insertion loss and isolation characteristics of an MIMO antenna having no phase change according to an embodiment.

Referring to FIG. 6, this shows an S-Parameter in a port at one side of the antenna. An antenna bandwidth shows about 152 MHz with respect to the center frequency of about 2.4 GHz. An isolation characteristic over an entire band shows about −13 dB with respect to the center frequency.

FIG. 7 is a view illustrating an S-Parameter in a port at the other side of the antenna. As shown in FIG. 6, the antenna bandwidth shows about 152 MHz with respect to the center frequency of about 2.4 GHz. The isolation characteristic over an entire band represents about −13 dB with respect to the center frequency.

When examining the isolation characteristic, an interference between antennas is less.

FIGS. 8 and 9 are views illustrating an elevation angle radiation pattern of an MIMO antenna having no phase change according to an embodiment.

Referring to FIGS. 8 and 9, at the center frequency of about 2.4 GHz, gain of about 2 dB is obtained and efficiency of about 85% is obtained in the antenna.

According to an embodiment, provided is a MIMO antenna with no phase change, in which its size is miniaturized by using an infinite wavelength metamaterial with no phase change and its gain and efficiency are improved by forming a decoupling structure at the center of a dipole antenna structure to suppress a mutual interference between antennas.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A multi input multi output (MIMO) antenna comprising:

A decoupling structure;

a first unit structure connected to a first end of the decoupling structure;

a second unit structure connected to a second end of the decoupling structure;

a first feeding unit connected to the first end of the decoupling structure and supplying a first electric energy to the first unit structure; and a second feeding unit connected to the second end of the decoupling structure and supplying a second electric energy to the second unit structure;

wherein each of the first feeding unit and the second feeding unit is disposed on a ground plate;

wherein the decoupling structure, the first unit structure, and the second unit structure are mounted on the ground plate by supporting of the first feeding unit and the second feeding unit;

wherein transmission lines of the first and second unit structures are bent in a meander form to vary a parallel inductance of the MIMO to a first predetermined value and to vary a series capacitance of the MIMO to a second predetermined value:

wherein the series capacitance is determined based on intervals of the transmission lines, and the parallel inductance is determined based on a height of the transmission lines vertically depressed;

wherein currents flow in a same direction through all transmission lines and the decoupling structure;

wherein a first end of the first feeding unit is in direct contact with a first end of the first unit structure and the first end of the decoupling structure:

Wherein the first end of the first feeding unit, the first end of the first unit structure and the first end of the decoupling structure interconnect at a first point, wherein a first end of the second feeding unit is in direct contact with a first end of the second unit structure and the second end of the decoupling structure; and wherein the first end of the second feeding unit, the first end of the second unit structure and the second end of the decoupling structure interconnect at a second point.

2. The MIMO antenna according to claim 1, wherein the first unit structure and the second unit structure are symmetrical with respect to the decoupling structure, and wherein each of the first unit structure and the second unit structure has a bent form of a 'ㄹ'-shape.

3. The MIMO antenna according to claim 1, wherein the decoupling structure has a 'U'-shape for suppressing a mutual interference between the first and second unit structures.

4. The MIMO antenna according to claim 1, wherein a line width of the first and the second unit structures as a single antenna is in a range of about 0.6 mm to about 1.0 mm and a length of the first and the second unit structures as the single antenna is in a range of about 45 mm to about 50 mm.

5. The MIMO antenna according to claim 4, wherein the line width of the unit structures constituting the single antenna is about 0.8 mm and the length of the unit structures as the single antenna is about 47.8 mm.

6. The MIMO antenna according to claim 1, wherein an interval between respective line widths of the first and the second unit structures constituting the antenna is about 2 mm and a height of the antenna is about 3 mm.

7. The MIMO antenna according to claim 1, wherein a first virtual single antenna comprising the first and the second unit structures has an area of about 9×7 $mm^2$, the decoupling structure having a 'U' shape has an area of about 3×7 $mm^2$, and a second virtual single antenna including the first unit structure, the second unit structure, and the decoupling structure has an area of about 21×7 $mm^2$.

8. The MIMO antenna according to claim 2, wherein the 'ㄹ'-shape of each of the first and the second unit structures is viewed as a 'ㄷ'-shape from a top view or from a side view.

* * * * *